US007264331B2

(12) United States Patent
Tanno

(10) Patent No.: US 7,264,331 B2
(45) Date of Patent: Sep. 4, 2007

(54) INK JET RECORDING APPARATUS

(75) Inventor: Ryuji Tanno, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 312 days.

(21) Appl. No.: 10/972,363

(22) Filed: Oct. 26, 2004

(65) Prior Publication Data

US 2005/0093940 A1 May 5, 2005

(30) Foreign Application Priority Data

Oct. 29, 2003 (JP) ..... 2003-369126

(51) Int. Cl.
*B41J 2/165* (2006.01)

(52) U.S. Cl. ..... 347/32; 347/22; 347/31

(58) Field of Classification Search ..... 347/31, 347/108, 33, 84, 85, 86, 32, 22
See application file for complete search history.

(56) References Cited

U.S. PATENT DOCUMENTS 5,757,399 A * 5/1998 Murayama et al. ..... 347/32
6,007,184 A * 12/1999 Terasawa et al. ..... 347/50
2001/0043256 A1* 11/2001 Seccombe et al. ..... 347/85
2003/0197773 A1* 10/2003 Kaeding et al. ..... 347/105
2003/0231226 A1* 12/2003 Ishikawa et al. ..... 347/47
2004/0119777 A1* 6/2004 Nakashima et al. ..... 347/32
2005/0174412 A1* 8/2005 Codos et al. ..... 347/102

* cited by examiner

*Primary Examiner*—An H. Do
*Assistant Examiner*—Sarah Al-Hashimi
(74) *Attorney, Agent, or Firm*—Finnegan, Henderson, Farabow, Garrett & Dunner, L.L.P.

(57) ABSTRACT

To prevent ink adhesion to a conduit connecting portion after removing an ink tank, there is provided an ink jet recording apparatus including a recording head for jetting ink onto a recording medium; an ink tank for storing ink; an ink tank housing section for attachably and detachably housing the ink tank; a conduit section for supplying ink from the ink tank to a recording head, the conduit section including a conduit connecting portion for connecting with a joint section to the ink tank; and an ink removing device having a removing member for removing ink adhering to a tip end of the conduit connecting portion when the ink tank has been parted from the conduit connecting portion.

10 Claims, 4 Drawing Sheets

INK JET RECORDING APPARATUS

FIELD OF THE INVENTION

The present invention relates to an ink jet recording apparatus, and particularly relates to an ink jet recording apparatus using high viscosity ink.

BACKGROUND OF THE INVENTION

Conventionally, as recording apparatuses capable of performing printing on various types of recording media including plain printing paper, ink jet recording apparatuses are known. An ink jet recording apparatus jets ink being a coloring material from nozzles provided through a surface of a recording head directly onto the recording medium, the surface facing the recording medium, thereby the ink lands on the recording medium, and soaks into or gets fixed onto the medium. Thus, the ink jet recording apparatus forms an image onto the recording medium. Ink jet recording apparatuses are quite excellent in simplicity of process, quietness in printing, and the quality of printing text and images.

Recently, an ink jet recording apparatus can form an image, not only on a plain paper sheet, but also on various recording media having no ink absorbance or quick-dryability, allowing it to use recording media of a material more stretchable than conventional media, wherein a UV-ray curable ink is employed, which is capable of reducing negative effects of stretchability and forms images with high quality.

As a method for storing ink, an ink tank with a structure being attachable and detachable has been developed (for example, Patent Document 1). An ink tank employed in the invention disclosed in Patent Document 1 has a connector formed of an elastic body, and has a mechanism for closing a penetration hole by penetration of a tube connecting section in a needle shape through the connector, thereby preventing ink leakage from the ink tank during removing the ink tank.

[Patent Document 1] TOKKOHEI No. 2-40508

However, ink that adheres to the tube connecting section after removing the ink tank, not only causes ink dropping, but also causes fixing of the ink to the tube connecting section, if the ink is left as it is. Thus, joint between the tube connecting section and an ink tank at the time of mounting the ink tank is degraded each time the ink tank is replaced, which causes leakage of ink due to connection failure or supply failure of ink due to clogging with ink. Particularly, UV-ray curable ink used in recent years has high viscosity at ordinary temperature and a property of adhesion when exposed to light such as UV-ray. Therefore, if ink is left in the state of adhering to a tube connecting section, subsequent problems such as leakage of ink easily occur.

SUMMARY OF THE INVENTION

The present invention has been devised taking the problems mentioned above into account and has an object to provide an ink jet recording apparatus capable of preventing ink from adhering to a tube connecting section after removing an ink tank.

The above problems can be solved by the following structure, according to the invention.

An ink jet recording apparatus in accordance with the invention includes a recording head for jetting ink onto a recording medium; an ink tank for storing ink; an ink tank housing section for attachably and detachably housing the ink tank; a conduit section for supplying ink from the ink tank to a recording head, the conduit section including a conduit connecting portion for connecting with a joint section of the ink tank; and an ink removing device having a removing member for removing ink adhering to a tip end of the conduit connecting portion when the ink tank has been parted from the conduit connecting portion.

Further, the problems can also be solved by the following preferable structures.

In a first aspect, there is provided an ink jet recording apparatus comprising a recording head for jetting ink onto a recording medium, an attachable and detachable ink tank having a joint section, an ink tank housing section for housing the ink tank, and a tube connecting section with a pointed tip to be inserted into the joint section, wherein the ink tank housing section is provided therein with an ink removing device including an ink absorbing member as the above described removing member that receives the tip of the tube connecting section.

According to the first aspect, as ink adhering to the tube connecting section can be securely absorbed, thereby preventing adhesion of ink. Thus, leakage of ink due to connection failure and supply failure of ink due to clogging with ink can be prevented.

In an ink jet recording apparatus in a second aspect, the ink absorbing material is housed in a holding frame that is rotated in a certain direction by a mechanism interlockingly with opening and closing operation of a lid section arranged at the ink tank housing section.

According to the second aspect, as the tip of the connecting section can be received interlockingly with the opening and closing operation of the lid section, it is possible to absorb ink adhering to the tube connecting section accompanying the attaching and detaching operation of the ink tank.

In an ink jet recording apparatus in a third aspect, the ink removing device includes a lever member connected to the removing member, a rotation device for rotating the lever member, and a detecting sensor for detecting whether or not an ink tank is present in the ink tank housing section. When the detecting sensor has detected a state that an ink tank has not been present in the ink tank housing section for a predetermined time, the rotation device rotates the lever member so that the removing member comes in contact with the tip end of the conduit connecting portion and removes ink adhering to the tip end of the conduit connecting portion.

According to the third aspect, as the tip of the connecting section can be received interlockingly with the operation of replacing an ink tank, it is possible to absorb ink adhering to the tube connecting section accompanying the attaching and detaching operation of the ink tank.

In an ink jet recording apparatus in a fourth aspect of the invention, UV-ray emitting devices having a UV-ray light source are provided on the both sides of the recording head, the sides being in the scanning direction.

According to the fourth aspect, as UV-ray curable ink having impacted a recording medium is cured by the UV-ray emitting devices, the ink can be securely cured and fixed on the recording medium.

In an ink jet recording apparatus in a fifth aspect of the invention, the recording head heats ink, the ink having a viscosity in the rage from 10 mPa·s to 500 mPa·s at 30° C., to a temperature in a range from 30° C. to 150° C. with a heating device so as to jet the ink with a size in a range from 2 pl to 20 pl for one dot.

If the ink amount per single ink droplet exceeds 20 pl, high resolution image recording is difficult, and if the ink amount per single ink droplet is less than 2 pl, the intensity of a formed image is low. Therefore, according to the fifth aspect, the recording head jets ink in ink droplets with a size in a range from 2 pl to 20 pl to form a high resolution image with small ink droplets. Further, the ink is heated to a temperature in a range from 30° C. to 150° C. at the time of jetting the ink, and thus the ink can be jetted with a preferable viscosity for jetting stability.

In an ink jet recording apparatus in a sixth aspect of the invention, the ink is a cation polymer ink.

Cation polymer ink is more sensitive to UV-ray compared with radical polymer ink and is less affected by oxygen in polymerization reaction. Therefore, according to the sixth aspect, even reducing the light emission amount required for curing ink jetted onto a recording medium, the ink can be easily fixed on the recording medium.

For an ink jet recording apparatus in a seventh aspect of the invention, the recording medium is a non-absorbing recording medium that does not absorb the ink.

According to the seventh aspect, as the recording medium does not have the property of absorbing ink, it is possible to prevent the ink from bleeding on the recording medium.

In the first aspect, the connecting section can be maintained clean, making it possible to reduce the burden on a user in performing printing of text and images with high quality and maintaining the high quality, with stable ink supply.

In the second and third aspects, since it is possible to absorb ink that adheres to the tube connecting section interlockingly with the attaching and detaching operation of the ink tank, the burden on the user in maintenance can be reduced.

In the fourth aspect, since UV-ray curable ink can be used, it is possible to form images on various recording media having no ink absorbance or quick-dryability as well as on plain paper sheets.

In the fifth aspect, even with an ink such as a UV-ray curable ink having high viscosity at normal temperature, it is possible to perform printing with high quality of text and images.

In the sixth aspect, it is possible to employ a light source with low output and a small amount of light emission as a UV-ray source to be used in the UV-ray emitting device, which achieves effective energy consumption, miniaturization of the light source, and reduction of manufacturing cost.

In the seventh aspect, it is possible to prevent expansion of a dot diameter due to bleeding of ink, thus realizing high quality printing of text and images.

PREFERRED EMBODIMENT OF THE INVENTION

Figure 1:
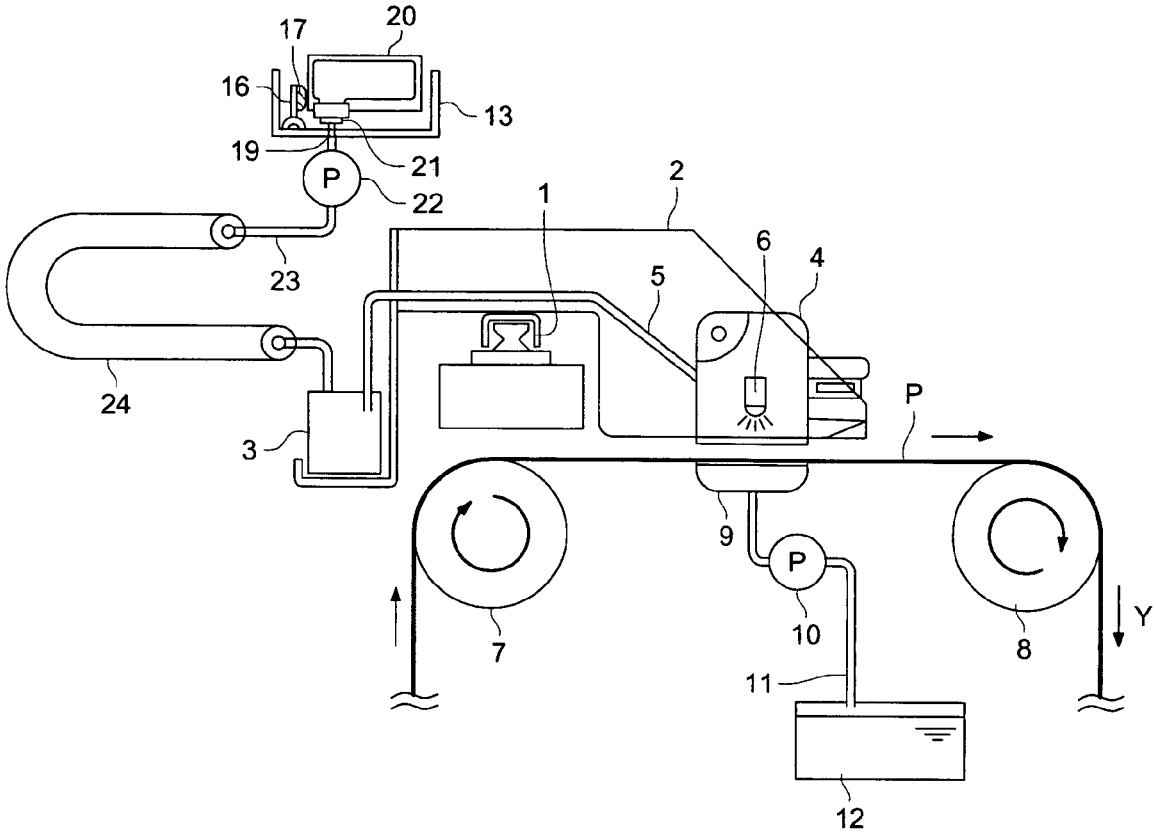
FIG. 1 is a schematic side-view of an ink jet recording apparatus of the invention.

In the following, a preferred embodiment of the invention will be described referring to the accompanying drawings. In the embodiment described below, various limitations are added, which are technically preferable to carry out the invention. However, the invention is not limited to the following embodiment or examples shown in the drawings.

An ink jet recording apparatus of the present invention will be described below, referring to FIGS. 1 to 4. In the ink jet recording apparatus of the present embodiment, each element member is covered by a housing, not shown. Inside the housing, a long guide rail 1 is arranged on the front side of the ink jet recording apparatus. The extending direction of the guide rail 1 herein is defined as a main scanning direction X. The guide rail 1 is provided with a carriage 2 which is supported in the state of being mounted astride the guide rail 1 and is reciprocally movable in the main scanning direction X guided by the guide rail 1.

A sub ink tank 3 with a small capacity for temporarily storing ink is provided on the backside of the carriage 2, and a recording head 4 for jetting ink toward a recording medium P is provided on the front side of the carriage 2. In the carriage 2, the sub tank 3 and the recording head 4 are connected with each other through a connection tube 5.

A heating device (not shown) for heating ink inside the recording head 4 is provided in the recording head 4. The heating device heats the ink to a range from 30° C. to 150° C., and thus the recording head jets the ink with a viscosity having been lowered.

A number of nozzles (not shown) for jetting ink in ink droplets with a size in a range from 2 pl to 20 pl are arranged on a jetting surface of the recording head 4 facing the recording medium P. Further, a UV-ray emitting device 6 for emitting UV-ray onto each ink droplet having landed on the recording medium is arranged on each of the both sides of the recoding head 4, the sides being parallel to a sub scanning direction Y. As a UV-ray source to be arranged on each UV-ray emitting device 6, a high-pressure mercury lamp, a metal halide lamp, a black light, a cold cathode tube, or a LED (Light Emitting Diode), for example, can be employed.

A flat shaped platen (not sown) for supporting the recording medium P on the non-recording surface side is arranged at a position below the recording head 4 and facing the nozzles of the recording head 4. In FIG. 1, a convey roller 7 and a convey roller 8 for conveying the recording medium P are arranged respectively on the upstream side and on the downstream side with respect to the platen. The convey rollers 7 and 8 rotate in the same direction, namely, clockwise in FIG. 1. By rotating the convey rollers 7 and 8, the recording medium P is conveyed from the upstream side to the downstream side in the state of being supported at the non-recording surface side. The convey direction of the recording medium P herein is defined as the sub scanning direction Y.

On one side of the platen, the side being parallel to the sub scanning direction Y, there is provided a maintenance mechanism for performing maintenance of the jetting surface of the recording head 4 and the nozzles. Under the maintenance mechanism, there are provided a cap member 9 which is ascendable and descendable to be able to cover the jetting surface of the recording head 4 facing the cap member 9 by scanning of the carriage 2, the cap member 9 having tight contact with the jetting surface, and a disposal ink tank 12 connected with the cap member 9 through a connection tube 11 which is provided with a pump 10 at a part thereof. When the cap member 9 covers the jetting surface, the maintenance mechanism applies negative pressure inside the cap member 9 with a pump 10 to absorb and remove ink adhering to the jetting surface and ink in nozzles, thereby performing maintenance of the jetting surface and the nozzles.

Above the back side of the ink jet recording apparatus, an ink tank housing section 13 formed in a box shape having an open top face is arranged, and a lid section 14 is connected to the ink tank housing section 13 with a hinge to fit on the open top face, wherein the lid section 14 is openable and closable.

On the inner bottom surface of the ink tank housing section 13, a rotation bar 15 is fitted to be able to rotate between a position where the bar 15 is approximately parallel to a side face of the ink tank housing section 13 and a position where the bar 15 is approximately parallel to the bottom surface. At the end of the rotation bar 15, a holding frame 16 in a box shape having an open face is fixed. Inside the holding frame 16, an ink absorbing member 17 formed with a recessed section in the center thereof is housed.

On the ink tank housing section 13, the lid section 14, and the holding frame 16, there may be provided a member having been subjected to light shielding treatment or being capable of shielding light so that the ink absorbing member 17 is prevented from exposure to external light.

The ink absorbing member 17 may have a structure attachable and detachable to and from the holding frame 16 to be replaceable. Also, a compression mechanism for compressing the ink absorbing member 17 may be provided to remove absorbed ink.

In the following, there will be described a series of operations in the process where the user takes out an ink tank to be replaced from the ink tank housing section 13, then the apparatus removes ink adhering to the tip of the tube connecting section 19, and then the user mounts a new ink tank.

Figure 2:
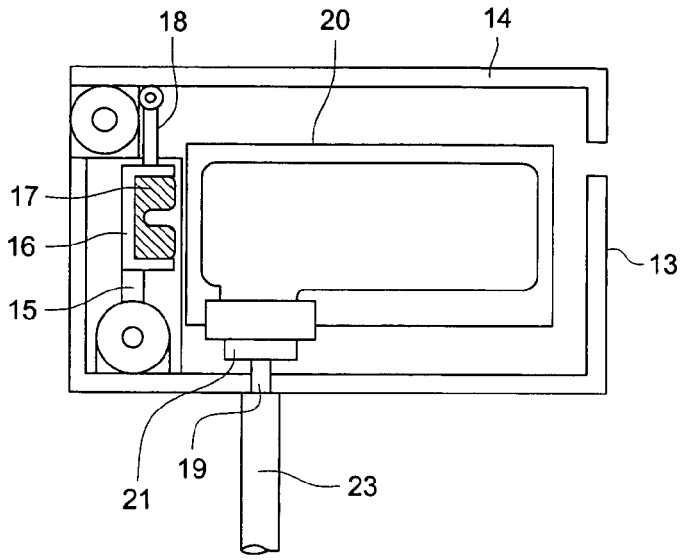
FIG. 2 is a longitudinal cross-sectional view showing a structure of an ink tank housing section in the state that an ink tank used on the ink jet recording apparatus of the invention is mounted.
Figure 3:
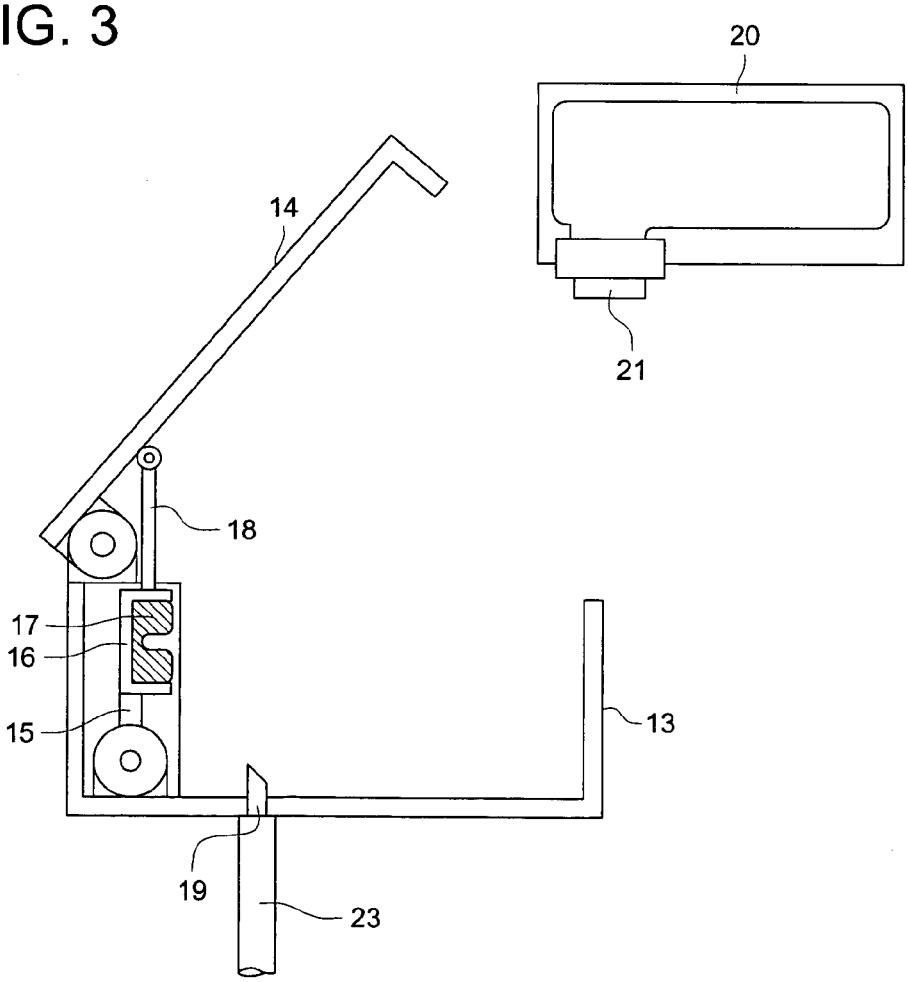
FIG. 3 is a longitudinal cross-sectional view showing the structure of the ink tank housing section at the time of detaching and attaching of an ink tank used on the ink jet recording apparatus of the invention.
Figure 4:
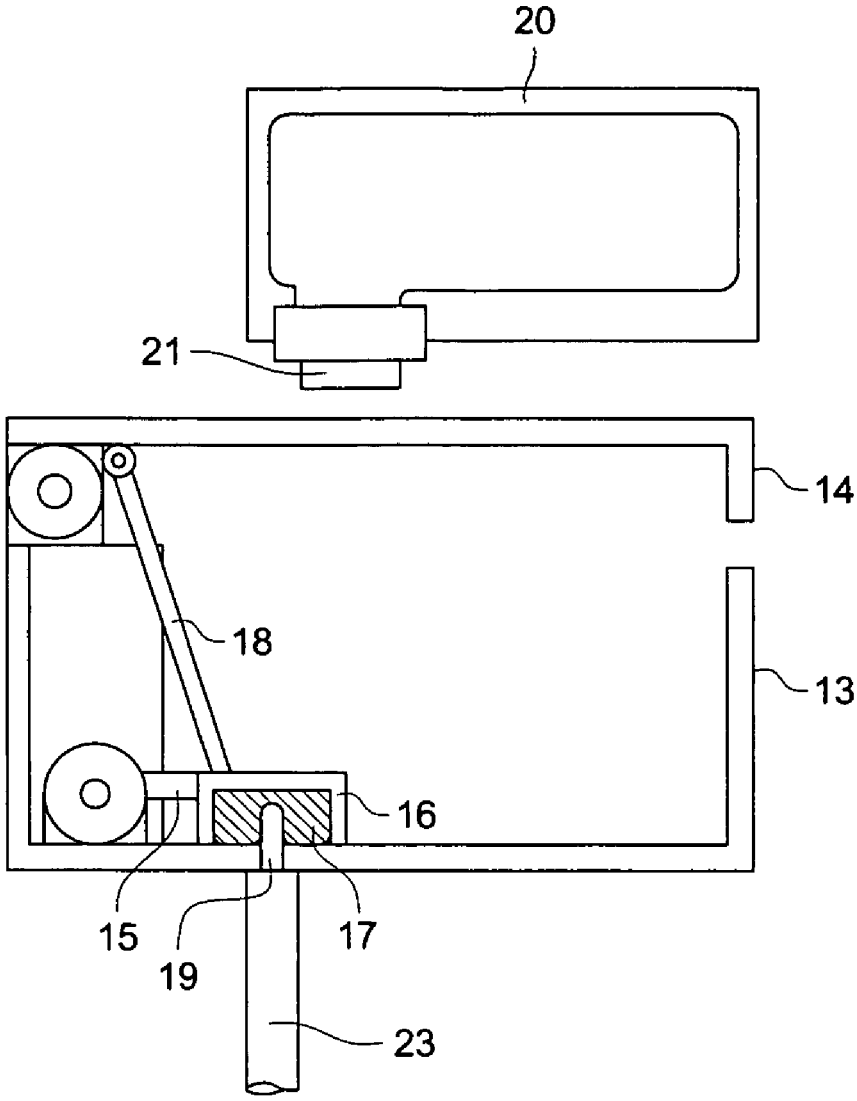
FIG. 4 is a longitudinal cross-sectional view showing the structure of the ink tank housing section in the state that an ink tank to be used on the ink jet recording apparatus of the invention is removed.

In an embodiment shown in FIGS. 2 to 4, on the inner side of the lid section 14, one end of a support rod 18 being a lever is rotatively fixed, while the other end of the support rod 18 is rotatively connected to a side of the holding frame 16. The rotation bar 15, the holding frame 16, and the support rod 18 provide a link mechanism. When the lid section 14 is open, the rotation bar 15 is held at a position (reference position) where the bar is approximately parallel to the side face of the ink tank housing section 13. When the lid section is closed, the rotation bar 15 is rotated interlockingly with the closing motion of the lid section 14 to a position where the bar is approximately parallel to the bottom surface of the ink tank housing section 13, and thus the absorbing member 17 receives the tip of the tube connecting section 19. Further, after a certain time period required for absorbing and removing the ink adhering to the tip of the tube connecting section 19, when the user opens the lid section 14, the link mechanism rotates the rotation bar 15 to a position approximately parallel to the side face of the ink tank housing section 13. Finally, the user mounts a new ink tank and closes the lid section 14.

Figure 5:
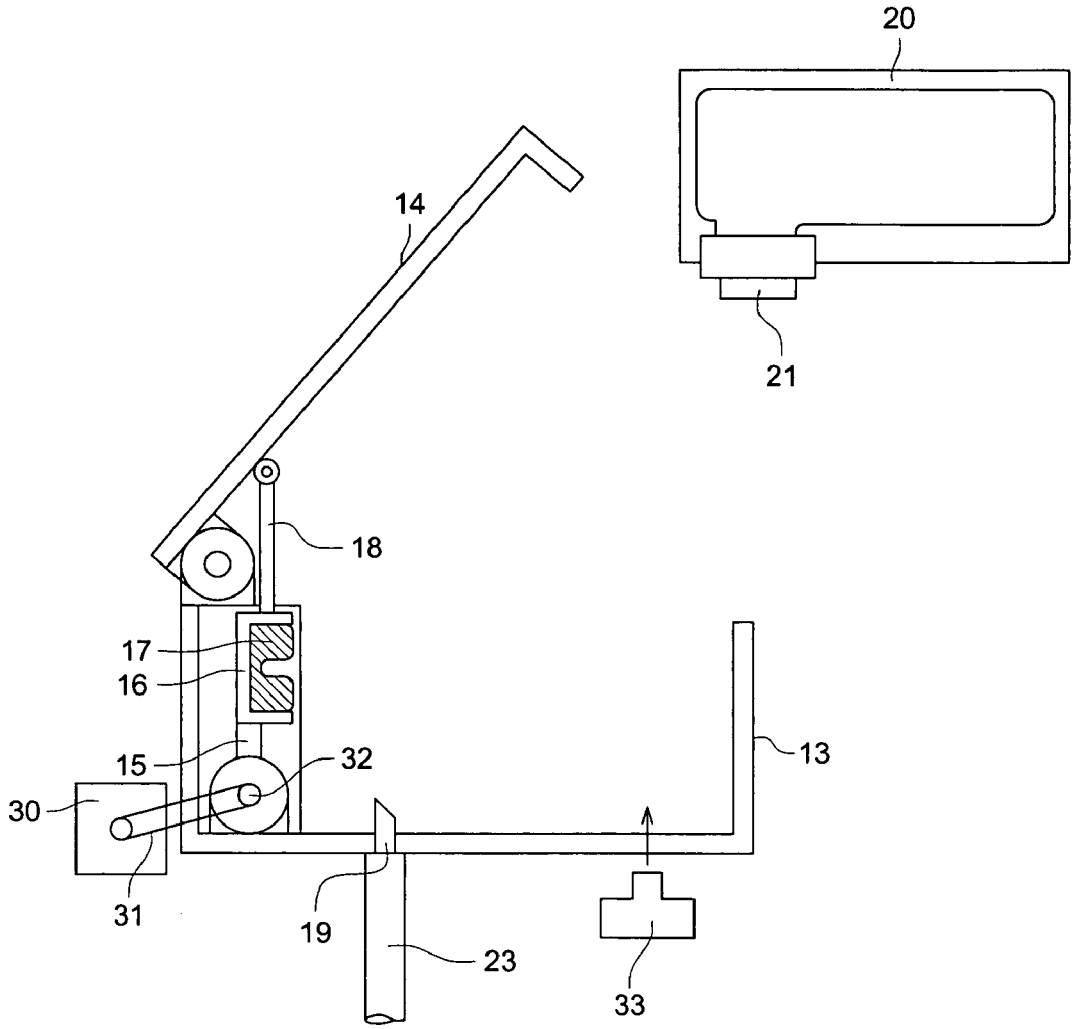
FIG. 5 is a longitudinal cross-sectional view showing another structure of an ink tank housing section.

Further, adhering ink may be removed with various structures or mechanisms and operations other than the above. Another example of a mechanism is shown in FIG. 5, wherein outside the ink tank housing section 13, a rotation motor 30 is provided in order to rotate the holding frame 16 having the ink absorbing member 17 therein. The rotation motor 30 is connected to a rotation shaft 32 of the rotation bar 15 via a rotation belt 31 which extends inside the ink tank housing section 13 through an opening formed through the side face of the ink tank housing section 13 so that the holding frame 16 including the ink absorbing member 17 is rotated. Further, a detection sensor 33 is arranged under the bottom of the ink tank housing section 13 to detect through a hole penetrating the bottom of the ink tank housing section 13 as to whether or not an ink tank is present in the ink tank housing section 13. When a user has opened the lid section 14 and taken out an old ink tank to be replaced, the detection sensor 33 detects that no ink tank is present in the ink tank housing section 13. After a predetermined time in this state, the rotation motor 30 starts running clockwise in the figure and rotates the rotation bar 15 via the rotation belt 31 and the rotation shaft 32 to the position where the holding frame 16 including the absorbing member 17 are on the bottom surface of the ink tank housing section 13, and thus the absorbing member 17 receives the tip of the tube connecting section 19. Further, after a predetermined time required for absorbing and removing ink adhering to the tip of the tube connecting section 19, the rotation motor 30 starts rotating the rotation bar 15 counter-clockwise in the figure to a position where the rotation bar 15 is approximately parallel to the side face of the ink tank housing section 13. Finally, the user mounts a new ink tank and closes the lid section 14.

Incidentally, in addition to the above mechanisms, for example, a mechanism may be arranged that rotates the holding frame 16 in a certain direction by operating a motor or a solenoid with On/Off switch operation interlockingly with opening and closing of the lid section 14.

Under the ink tank housing section 13, a tube connecting section 19 formed with a pointed tip is arranged penetrating the bottom surface of the ink tank housing section 13, wherein the tip of the tube connecting section 19 penetrates the bottom surface and extend to a joint section 21 of the ink tank 20, thereby having contact with the ink tank 20.

The ink tank 20 has a large capacity for storing ink, and the joint section 21 thereof is formed of an elastic body. Further, the entire ink tank 20 is formed of resin, for example, so that inside of the ink tank 20 is not exposed to external lights.

The other end of the tube connecting section 19 is connected with an ink supply tube 23 provided with a pump 22 for sucking the ink stored in the ink tank 20 and discharging the ink, and is further connected to a sub ink tank 3 through the ink supply tube 23.

The ink supply tube 23 is formed of a flexible material such as rubber in a tube shape, having a tightly closed structure so that air does not enter the tube, and is arranged to penetrate into a caterpillar 24.

The ink is a UV-ray curable ink that is cured by emitting UV-ray. Photocurable inks can be broadly categorized into radical polymer inks containing a radical polymer compound as a polymer compound and cation polymer inks containing a cation polymer compound as a polymer compound. Inks of both the categories can be applied to the present embodiment, and a hybrid type ink in combination of a radical polymer ink and a cation polymer ink may be employed as an ink to be used in the present embodiment. However, cation polymer inks, which suffer from less or no inhibition of polymerization by oxygen, are excellent in functions and for general purpose, and therefore, it is particularly preferable to use a cation polymer ink.

As a recording medium P, either non-absorbent recording medium or absorbent recording medium can be employed. Non-absorbarce herein means that a recording medium does not absorb ink. In the invention, recording media P with a transfer amount of ink by Bristow method less than 0.1 ml/mm$^2$, that is, virtually 0 ml/mm$^2$, are categorized as non-absorbent recording media, wherein other recording media are categorized as absorbent recording media. The non-absorbent recording media include recording media made of a material such as resin. The absorbent recording medium includes various papers such as plain printing paper, recycle paper, glossy paper, various cloths, and various non-cloths. Particularly, as a recording medium P to be used in the present embodiment, it is possible to apply a non-absorbent film of resin transparent or opaque used for light packing.

Operation in the present embodiment will be described below.

During recording operation of the ink jet recording apparatus, the convey rollers 7 and 8 are driven to repeat predetermined rotation and stop so that the recording medium P is intermittently conveyed in the sub-scanning direction Y on the platen in the state that the platen supports the recording material P.

Each time the convey rollers 7 and 8 stop, the carriage 2 is operated to reciprocally move in the main-scanning direction X just above the recording medium P. Accordingly, the sub ink tank 3, the recording head 4, and the UV-ray emitting device 6 mounted on the carriage 2 reciprocally move just above the recording medium P following the movement of the carriage 2.

In this process, ink supplied from the sub ink tank 3 to the recording head 4 is heated by a heating device provided inside the recording head 4, jetted from each nozzle onto the recording surface of the recording medium P, and the UV-ray sources provided on the respective UV-ray emitting devices 6 starts burning. In such a manner, just after having impacted the recording surface of the recording medium 6, the ink jetted from the recording head 4 is exposed to UV-ray from the UV-ray sources provided on the UV-ray emitting devices 6 and the exposed ink is fixed on the recording surface of the recording medium P.

Thereafter, the ink jet recording medium repeats the above operations, thereby sequentially recording a certain image including a plurality of dots.

With the structure of the ink tank housing section shown in FIGS. 2 and 3, to remove the ink tank 20 which is empty as a result of consuming ink through the image forming process, the user opens the lid section 14 and picks up the ink tank 20, then the tip of the tube connecting section 19 is detached from the joint section 21 arranged at the ink tank 20, thereby the ink tank 20 is completely removed, and finally, the user closes the lid section 14. In this process, interlockingly with the operation of closing the lid section 14, the rotation bar 15 arranged inside the ink tank housing section 13 is rotated from the reference position to the position where the rotation bar 15 is approximately parallel to the bottom surface of the ink tank housing section 13, and thus the tip of the tube connecting section 19 is received by the recessed portion of the absorbing member 17 housed in the holding frame 16. On the other hand, to mount a new ink tank 20, the lid section is opened, then the tip of the tube connecting section 19 is connected to the joint section 21 of the ink tank 20 penetrating through the bottom portion of the ink tank housing section 13, thereby the new ink tank 20 being mounted, and finally, the lid section 14 is closed. Incidentally, in the operation of closing the lid section 14 in the state that the ink tank 20 is mounted, the holding frame 16 having the ink absorbing member 17 contacts with the ink tank 20, thus being prevented from rotating toward the horizontal direction.

As described above, with the ink jet recording apparatus of the present embodiment, since ink adhering to the tube connecting section 19 can be securely absorbed and removed, maintaining the tube connecting section 19 clean prevents leakage of ink due to connection failure or supply failure of ink caused by clogging. Thus, it is possible to attempt to reduce the burden on the user in performing printing of text and images with high quality and maintaining the high quality, with stable ink supply.

Further, as the tip of the tube connecting section 19 can be received interlockingly with the opening and closing operation of the lid section 14, it is possible to absorb and remove ink adhering to the tube connecting section 19 interlockingly with detaching and attaching operation of the ink tank 20, thereby the burden on the user in maintenance being reduced.

Further, as UV-ray curable ink having landed on the recording medium P is cured by the UV-ray emitting devices 6, it is possible to securely cure and fix the ink on the recording medium P, and thus, image forming can be performed, not only on plain paper sheets, but also on various recording media P having no absorbance or quick-dryability.

Still further, the recording head 4 jets ink in droplets in a range from 2 pl to 20 pl, which realizes a precise image quality. Also, ink is heated to a temperature in a range from 30° C. to 150° C., thereby making it possible to jet ink with a preferable viscosity in a viewpoint of jetting stability. Thus, even with an ink such as UV-ray curable ink having high viscosity at a normal temperature, printing of text and images in high quality can be achieved.

Yet further, cation polymer ink is more sensitive to UV-ray compared with radical polymer ink and is less affected by oxygen in polymerization reaction. Therefore, even reducing the light emission amount required for curing ink jetted onto recording medium P, the ink can be easily fixed onto the recording medium P. Thus, it is possible to employ a light source with a low output power having a small emission amount as a UV-ray source to be used as the UV-ray emitting device 6, thereby effective energy consumption, miniaturization of a light source, and reduction in manufacturing cost.

As the recording medium does not have the property of absorbing ink, the ink is prevented from bleeding on the recording medium P, and growing of dot diameters due to ink bleeding can be prevented, thereby realizing printing of text and images in high quality.

What is claimed is:

1. An ink jet recording apparatus comprising:

a recording head for jetting ink onto a recording medium;

an ink tank for storing ink;

an ink tank housing section for attachably and detachably housing the ink tank;

a conduit section for supplying ink from the ink tank to a recording head, the conduit section including a conduit connecting portion for connecting with a joint section of the ink tank; and an ink removing device for removing ink adhering to a tip end of the conduit connecting portion, the ink removing device including a removing member and mechanism for moving the ink removing member to the tip end of the conduit connecting portion when the ink tank has been parted from the conduit connecting portion.

2. The ink jet recording apparatus of claim 1, wherein the ink removing member is an ink absorbing member.

3. The ink jet recording apparatus of claim 1, wherein the ink removing device includes a light shielding member that covers the tip end of the conduit connecting portion and shields external light.

4. The ink jet recording apparatus of claim 3, wherein the light shielding member is a holding frame for holding the removing member.

5. The ink jet recording apparatus of claim 1, wherein, the ink removing device includes a lever member connected to the removing member, and the lever member rotates interlockingly with opening and closing operation of a lid section arranged at the ink tank housing section so that the removing member comes in contact with the tip end of the conduit connecting portion and removes ink adhering to the tip end of the conduit connecting portion.

6. The ink jet recording apparatus of claim 1, wherein, the ink removing device includes:

a lever member connected to the removing member;

a rotation device for rotating the lever member; and a detecting sensor for detecting whether or not an ink tank is present in the ink tank housing section, and when the detecting sensor has detected a state that an ink tank has not been present in the ink tank housing section for a predetermined time, the rotation device rotates the lever member so that the removing member comes in contact with the tip end of the conduit connecting portion and removes ink adhering to the tip end of the conduit connecting portion.

7. The ink jet recording apparatus of claim 1, wherein a UV-ray emitting device provided with a UV-ray source is mounted on each of both sides, in a scanning direction, of the recording head.

8. The ink jet recording apparatus of claim 1, wherein the recording head heats ink, the ink being a liquid having a viscosity in a range from 10 mPa·s to 500 mPa·s at 30° C., to a temperature in a range from 30° C. to 150° C. with a heating device so as to jet the ink with a size in a range from 2 pl to 20 pl for one dot.

9. The ink jet recording apparatus of claim 1, wherein the ink is a UV-ray curable ink being a cation polymer.

10. The ink jet recording apparatus of claim 1, wherein the recording medium is a non-absorbing recording medium that does not absorb ink.

* * * * *